United States Patent [19]

Laing et al.

[11] 4,092,226

[45] May 30, 1978

[54] PROCESS FOR THE TREATMENT OF METAL SURFACES BY ELECTRO-DEPOSITION OF METAL COATINGS AT HIGH CURRENT DENSITIES

[76] Inventors: Nikolaus Laing, Hofener Weg 35-37, 7141 Aldingen; Peter Schaper, Am Remsufer, 7141 Neckarrems, both of Germany; Werner Heierli, Elsastrasse 6, 4600 Olten, Switzerland

[21] Appl. No.: 638,928

[22] Filed: Dec. 8, 1975

[30] Foreign Application Priority Data

Dec. 11, 1974 Switzerland ..... 16501/74

[51] Int. Cl.[2] ..... C25D 3/04; C25D 3/10

[52] U.S. Cl. ..... 204/51; 204/DIG. 9

[58] Field of Search ..... 204/51, DIG. 9

[56] References Cited

U.S. PATENT DOCUMENTS

| | | | |
|---|---|---|---|
| 1,527,734 | 2/1925 | Huggins | 204/DIG. 9 UX |
| 1,918,605 | 7/1933 | Jones | 204/51 |
| 2,046,440 | 7/1936 | Adey | 204/DIG. 9 UX |
| 2,852,447 | 9/1958 | Hausner | 204/51 X |
| 3,282,812 | 11/1966 | Brown et al. | 204/51 |
| 3,318,786 | 5/1967 | Faust et al. | 204/51 |
| 3,414,492 | 12/1968 | Oleson et al. | 204/51 |
| 3,475,294 | 10/1969 | Seyb et al. | 204/51 |
| 3,505,183 | 4/1970 | Seyb et al. | 204/51 |
| 3,616,434 | 10/1971 | Hausner | 204/51 X |
| 3,886,053 | 5/1975 | Leland | 204/51 X |

FOREIGN PATENT DOCUMENTS

| | | | |
|---|---|---|---|
| 1,421,984 | 11/1968 | Germany | 204/51 |
| 1,034,494 | 6/1966 | United Kingdom | 204/51 |
| 1,148,070 | 4/1969 | United Kingdom | 204/51 |
| 1,164,670 | 9/1969 | United Kingdom | 204/43 |
| 1,322,152 | 7/1973 | United Kingdom | 204/51 |
| 1,291,566 | 10/1972 | United Kingdom | 204/51 |
| 190,749 | 12/1966 | U.S.S.R. | 204/51 |

OTHER PUBLICATIONS

John L. Griffin, Plating, pp. 196–203, Feb. 1966.

J. C. Saiddington et al., Plating, pp. 923–930, Oct. 1974.

*Primary Examiner*—G. L. Kaplan

*Attorney, Agent, or Firm*—Pennie & Edmonds

[57] ABSTRACT

A method of electroplating a crack-free hard chromium deposit comprises having present in the electroplating bath a complex halogen-containing compound which disassociates in an aqueous solution while maintaining the bond of a halogen in the complex. A plating voltage is used which periodically superimposes high voltage pulses on the base voltage.

1 Claim, No Drawings

PROCESS FOR THE TREATMENT OF METAL SURFACES BY ELECTRO-DEPOSITION OF METAL COATINGS AT HIGH CURRENT DENSITIES

THE PRIOR ART

In the deposition of metal coatings, like nickel, chromium, tungsten cobalt and similar coatings on metal surfaces, the ductility and hardness are, in most cases, measures of the usefulness of the coating. Both properties depend on the kind of electro-deposition. In this context, the inclusion of hydrogen in the deposited layer, which is due to hydrogen precipitation, is a disadvantage. This inclusion is the greater the higher the current density. For this reason, the following current density values have hitherto been regarded as upper limits: 25 Amp/dm$^2$ for copper, 75 Amp/dm$^2$ for chromium, 40 Amp/dm$^2$ for tungsten and 25 Amp/dm$^2$ for cobalt. At higher current densities, the quality of the deposited layer rapidly deteriorates due to hydrogen inclusion.

Thus, it is known, for example, to obtain chromium coatings with a hardness of up to 1,000 HV by operating with an addition of 1 to 5% sulphuric acid, at an electrolyte density of 22° to 30° Be and a temperature of 50° to 55° C and adjusting a current density of up to 50 Amp/dm$^2$. The current yield in this process lies between 14 and 18%. In this known process, the thickness of the layer grows by about 0.3 microns per minute.

In sulphate baths, which are also known, it has been possible to increase simultaneously the current yield, and thus the deposition rate of the chromium. For example, with a mixture of strontium sulphate and potassium hexafluoro-silicate instead of sulphuric acid, bright chromium deposits with a hardness of 900 HV at a rate of chromium deposition of between 0.35 and 0.4 microns per minute can be obtained, with a current yield of 22%. The current densities reach up to 45 Amp/dm$^2$, the electrolyte density is 24° - 25° Be and the temperature, about 54° C. Mat deposits with a hardness of 1,050 HV can be obtained at a rate of chromium deposition between 0.45 and 0.5 microns per minute, current densities of up to 60 Amp/dm$^2$ an electrolyte density of 32° Be and a temperature of 50° C. In these known baths, self-regulation is achieved because the potassium hexafluoro-silicate serves as a buffer for the strontium sulphate, which is difficult to dissolve.

In spite of the improvements memtioned above, the said additions of strontium sulphate and potassium hexafluoro-silicate act as catalysts rather than activation agents.

The density, and pH value and conductivity of the electrolytes used hitherto must be held within narrow limits.

It has already been proposed to use commercial dichloromalonic acid for deposition from chromium baths in order to achieve higher hardness of chromium coatings and higher current densities. It has been found that, at high current densities such as those above 100 Amp/dm$^2$, only coatings containing cracks can be obtained in this way.

THE OBJECT OF THE INVENTION

The object of the invention is the production of hard, ductile deposits, free of built-in stresses, i.e. substantially without cracks, at high current densities, namely, current densities of 100 Amp/dm$^2$ and over.

DESCRIPTION OF THE INVENTION

It has been found that such deposits can be obtained if the transport of hydrogen towards the cathode is inhibited so far as possible. In this context, it was found unexpectedly that, not only the hydrogen inclusions in the deposited layer can be avoided, but also the plating speed, i.e. the deposition rate, can be raised to an extremely high value, a combination which is not possible without inhibition of the hydrogen precipitation. This fact is an economic factor of great significance because the baths can be better utilised than hitherto and, at the same time, an extremely high quality of the deposited layer is achieved. Such a combination has hitherto been considered impossible because, in the known processes, the quality of the deposited layers deteriorates exponentially with increasing current density.

It was found that the inhibition of hydrogen precipitation can be accomplished by the conduct of the plating process, by the composition of the bath and by the joint effect of both measures.

In one process according to the invention, a base voltage is applied to the electrodes during the deposition. The voltage is larger than the precipitation potential of the deposited metal but smaller than the precipitation potential of the hydrogen in the particular bath used. Periodic voltage pulses of substantially higher voltage are superimposed on this base voltage.

The effect of this measure is that, during the pulse duration, extremely high current flow and several atomic layers of the deposited metal are precipitated whilst, during the intervals between the pulses, the hydrogen molecules are diffused out of the deposit and can escape from the surface as a gas.

In a further process according to the invention, compounds with one or several complexed halogens are used which dissociate in aqueous solution whilst maintaining the bond of the halogen in the complex. In such compounds, the anion, in its dissociated form, is a large complex with low ionic mobility so that the hydrogen release at the cathode is inhibited thereby.

Preferred deposition baths contain single or multiple halogen-substituted, but, particularly, single or multiple chlorine-substituted, aromatic or aliphatic carboxylic acids such as, e.g. mono- di- or tri-halogen acetic acid, mono, di- or tri-halogen propionic acid, mono- or di-halogen succinic acid, mono- or di-adipic acid, ortho-, meta- or para-halogen-mono- or di-benzoic acid.

Although both possibilities, namely the pulsed plating process and the novel bath additives result in an inhibition of hydrogen migration towards the cathode, it is the pulsed process which has the overriding effect on ductility and the novel bath composition, or hardness. Both process measures used together yield, for example, chromium deposits with a Vickers hardness greatly exceeding 1,500 and an excellent ductility, never achieved by processes used hitherto.

With the help of the process according to the invention, using the novel bath composition, not only the cation precipitation, but also the anion precipitation, is activated, namely, in the form that the conductivity of the bath and thus the current densitiy and the rate of deposition are substantially enhanced compared with known processes.

If the conductivity of, for example, a chromium bath is increased in this way, so that the electrolytic process takes place at current densities exceeding 100 Amp/dm$^2$, and preferably between 130 Amp/dm$^2$ and 400 Amp/dm$^2$, both mat and very bright deposits can be obtained which, depending on the components of the bath, have hardnesses of up to 1,600 HV. By means of the said activation of the anion precipitation, the current yield is increased to between 29 and 33% and the throwing power of the electrolyte is so enhanced that in the Hull cell test a 74 to 97 mm long portion of the cathode is plated with chromium.

The following have been found to be suitable chlorine compounds for the deposition of chromium: chlorinated organic acids as, for example, mono, di- and tri-chloro-acetic acid, mono- and di-chloro-propionic acid, mono- and di-chloro-succinic acid, mono- and di-chloro-adipic acid, ortho-, meta- or para-mono-chloro-benzoic acid or di-chloro-benzoic acid with chlorine atoms in any position in the benzene ring. Potassium chlorate and potassium perchlorate are also suitable chlorine compounds for the activation of the anion precipitation.

In case the additive of one of these acids reduces the pH value too much and would, therefore, make the bath too aggressive in relation to copper alloys, light alloys or pressure die casting alloys and the like, the additives according to the invention are partially or wholly neutralised with sodium, or better still, with potassium compounds until the pH value of the electrolyte amounts to between 0.4 and 1.9.

The invention will be explained with the help of examples.

EXAMPLE 1

The following bath is made up: 180g/l chromium trioxide ($CrO_3$), 4g/l strontium sulphate ($SrSO_4$), and 12 g/l potassium silico-fluoride ($K_2SiF_6$) are added to distilled water. A temperature of 60° C is set and the activation of the 3-valent chromium is awaited. Thereupon, 0.8 g/l di-chloro-succinic acid are added.

The anode consists of an insoluble lead anode. The cathode is a steel sheet which has about half the surface area of the anode. Deposition upon the cathode sheet proceeds at a current density of 160 Amp/dm$^2$ and a temperature of 54° C. The deposition continues for 20 minutes, the voltage amounts to 8.8 – 9.0 volts.

A layer of 31 microns thickness if obtained, which corresponds to a deposition rate of 1.55 microns per minute. The hardness is measured by a micro-hardness tester (Durimed-Leitz) under a load of 25 pond. An average hardness of 1680 HV (Vickers hardness) is found. The coating is a bright film and has the usual cracks.

EXAMPLE 2

The same test as in Example 1 is repeated, however, during the deposition, a base current with a current density of 14 Amp/dm$^2$ at a voltage of 1.7 volts is used as the electrolysis current. Current pulses with a mean current density of 180 Amp/dm$^2$ are superimposed on the base current. The peak voltage amounts to about 15 volts. The pulse duration amounts to 3 milliseconds and the interval between pulses, 9 milliseconds. The coating resulting from this process has a hardness of 1750 HV and shows an appearance entirely free of cracks under the microscope.

EXAMPLE 3

The following bath is made up: 250 g/l chromium tri-oxide, 5 g/l potassium dichromate, 5 g/l strontium sulphate and 14 g/l potassium silico-fluoride are added to distilled water. A temperature of 60° C is set and the activitation of 3-valent chromium is awaited. Thereupon, 1.1 g/l of di-chloro-adipic acid are added.

The anode consists of an insoluble lead anode. The cathode is a steel sheet which has about half the surface area of the anode. Deposition proceeds upon the cathode sheet at a current density of 280 Amp/dm$^2$ and a temperature of 54° C. The deposition lasts 20 minutes; the voltage amounts to about 9.0 volts.

A layer of 48 microns is obtained, corresponding to a deposition rate of 2.4 microns per minute. The hardness is measured by a micro-hardness tester (Durimed-Leitz) under a load of 25 pond. An average hardness of 1650 HV (Vickers hardness) is found. The coating is a silver-grey film and has the individual cracks.

EXAMPLE 4

The same test as in Example 3 is repeated, however, during the deposition, a base current with a current density of 14 Amp/dm$^2$ at a voltage of 1.7 volts is used as the electrolysis current. Current pulses with a mean current density of 280 Amp/dm$^2$ are superimposed on the base current. The peak voltage amounts to about 16 volts. The pulse duration amounts to 3 milliseconds and the interval between pulses, 9 milliseconds. The coating resulting from this process has a hardness of 1780 HV and shows an appearance entirely free of cracks under the microscope.

EXAMPLE 5

The following bath is made up: 300 g/l chromium tri-oxide, 6 g/l potassium dichromate, 5.5 g/l strontium sulphate and 15.5 g/l potassium silicofluoride are added to distilled water. A temperature of 60° C is set and the activation of 3-valent chromium is awaited. Thereupon, 0.4 g/l dichloro-acetic acid is added.

The anode consists of an insoluble lead anode. The cathode is a steel sheet which has about half the surface area of the anode. Deposition upon the cathode sheet proceeds at a current density of 400 Amp/dm$^2$ and a temperature of 54° C. The deposition lasts 20 minutes; the voltage amounts to about 10.1 volts.

A layer of 84 microns is obtained, corresponding to a deposition rate of 4.2 microns per minute. The hardness is measured by a micro-hardness tester (Durimed-Leitz) under a load of 25 pond. An average hardness of 1700 HV (Vickers hardness) is found. The coating is a pearly grey film and has cracks.

EXAMPLE 6

The same test as in Example 5 is repeated, however, during the deposition, a base current of a current density of 14 Amp/dm$^2$ at a voltage of 1.7 volts is used as the electrolysis current. Current pulses with a mean current density of 400 Amp/dm$^2$ are superimposed on the base current. The peak voltage amounts to about 22 volts. The pulse duration amounts to 3 milliseconds and the interval between pulses, 9 milliseconds. The coating resulting from this process has a hardness of 1750 HV and shows a pearly grey appearance free of cracks under the microscope.

EXAMPLE 7

The following bath is made up: 250 g/l chromium trioxide, 5 g/l strontium sulphate and 14 g/l potassium silico-fluoride are added to distilled water. A temperature of 60° C is set and the activation of the 3-valent chromium is awaited. Thereupon, 0.25 g/l tri-chloro-acetic are are added.

The anode consists of an insoluble lead anode. The cathode is a steel sheet which has about half the surface area of the anode. Deposition upon the cathode sheet proceeds at a current density of 100 Amp/dm$^2$ and a temperature of 54° C. The deposition continues for 12 minutes, the voltage amounts to about 9.8 volts.

A layer of 21 microns thickness is obtained, which corresponds to a deposition rate of 1.75 microns per minute. The hardness is measured by a micro-hardness tester (Durimed-Leitz) under a load of 25 pond. An average hardness of 1630 HV (Vickers hardness) is found. The coating is a bright film and has no cracks.

EXAMPLE 8

The following bath is made up: 400 g/l chromium trioxide, 10 g/l strontium sulphate and 8 g/l potassium silico-fluoride are added to distilled water. A temperature of 60° C is set and the activation of the 3-valent chromium is awaited. Thereupon 5.2 g/l dichloro-benzoic acid are added.

The anode consists of an insoluble lead anode. The cathode is a steel sheet which has about half the surface area of the anode. Deposition upon the cathode sheet proceeds at a current density of 300 Amp/dm$^2$ and a temperature of 54° C. The deposition continues for 20 minutes, the voltage amounts to 10.2 volts.

A layer of 108 microns thickness is obtained, which corresponds to a deposition rate of 5.4 microns per minute. The hardness is measured by a micro-hardness tester (Durimed-Leitz) under a load of 25 pond. An average hardness of 1500 HV (Vickers hardness) is found. The coating is a mat grey film and has individual cracks. The bonds of the chromium coatings described in the Examples 1 to 8 to their substrates were examined by means of a non-destructive electron spectrum analyser made by Japan Electron Optical Lab. It was found that the transitions of the chromium layers into the steel surfaces of the substrates, which form the cathodes are continous and are situated in an inter-layer region, i.e. the coating material diffuses into the boundary layer of the respective substrate. A discontinuous transition resulted within a diffusion layer of 0.8 - 1.25 microns thickness in the pulsed plating process (Examples 2, 4, 6). This diffusion zone is smaller in the Examples 1, 3, and 5, in which only the novel baths are used but no current pulses are applied, and amounts to between 0.25 and 0.60 microns. In conventional chromium coatings, the transition is entirely discontinuous. Thus, it has been clearly proved that a diffusion zone is present only when a hydrogen inhibition has taken place, i.e. that, by means of hydrogen inhibition, a much more intimate bond of the deposited material to the substrate metal has been obtained.

We claim:

1. Process for the treatment of metal surfaces to produce a substantially crack-free surface having a hardness factor in excess of 1500 HV by electro-deposition of chromium at current densities in excess of 100amp/dm$^2$ utilizing electrodes extending into a plating bath where the bath contains an aqueous solution having chromium therein comprising the steps of including in the bath a compound having a complex halogen which disassociates in an aqueous solution while maintaining the bond of halogen in the complex, applying a base voltage across the electrodes which is larger than the precipitation potential of the deposited chromium and smaller than the precipitation of hydrogen in the plating bath, and periodically superimposing high voltage pulses on the base voltage wherein the high voltage pulses are 3 to 7 times greater than the base voltage.

* * * * *